United States Patent [19]

Volk

[11] Patent Number: 4,892,460

[45] Date of Patent: Jan. 9, 1990

[54] PROPELLER BREEZE ENHANCING BLADES FOR CONVENTIONAL CEILING FANS

[76] Inventor: Steve J. Volk, 7900 Tatum Waterway Dr., Miami Beach, Fla. 33141-1936

[21] Appl. No.: 303,938

[22] Filed: Jan. 30, 1989

[51] Int. Cl.[4] ..... F04D 29/38

[52] U.S. Cl. ..... 416/62; 416/5; 416/23

[58] Field of Search ..... 416/62, 146 R, 5, 23

[56] References Cited

U.S. PATENT DOCUMENTS

| | | | |
|---|---|---|---|
| 871,729 | 11/1907 | McChord | 416/5 |
| 1,055,947 | 3/1913 | Schwartzberg | 416/62 |
| 1,990,291 | 2/1935 | Larsen | 416/23 |
| 2,450,440 | 10/1948 | Mills | 416/223 R |
| 2,990,889 | 7/1961 | Welch | 416/62 |
| 3,077,229 | 2/1963 | Heintzelman | 416/62 |
| 3,952,712 | 4/1976 | Hermanson | 416/62 X |
| 4,618,313 | 10/1986 | Mosiewicz | 416/62 X |
| 4,662,823 | 5/1987 | Cooke | 416/62 X |
| 4,722,608 | 2/1988 | Saltman | 416/62 X |

FOREIGN PATENT DOCUMENTS

| | | | |
|---|---|---|---|
| 444829 | 2/1949 | Italy | 416/62 |
| 41295 | 2/1988 | Japan | 416/23 |
| 496700 | 12/1938 | United Kingdom | 416/62 |
| 856668 | 12/1960 | United Kingdom | 416/62 |
| 2193618 | 2/1988 | United Kingdom | 416/62 |

*Primary Examiner*—Everette A. Powell, Jr.

[57] ABSTRACT

Aerodynamically designed and improved auxiliary blade attachment that wedge firmly onto the trailing edges of the main blades of conventional ceiling fans. The highly functional shape and super lightweight one-piece construction of these easy-to-use auxiliary blades and their strategic placement on the main fan blades serve to heighten the angle of incidence and thus create an intensified dual air current laterally and downwardly in relation to the fan's central core. The result is a dynamic increase of cubic feet of propeller-cooled air per minute without electrically increasing the velocity of ceiling fan rotation.

10 Claims, 3 Drawing Sheets

FIG. A
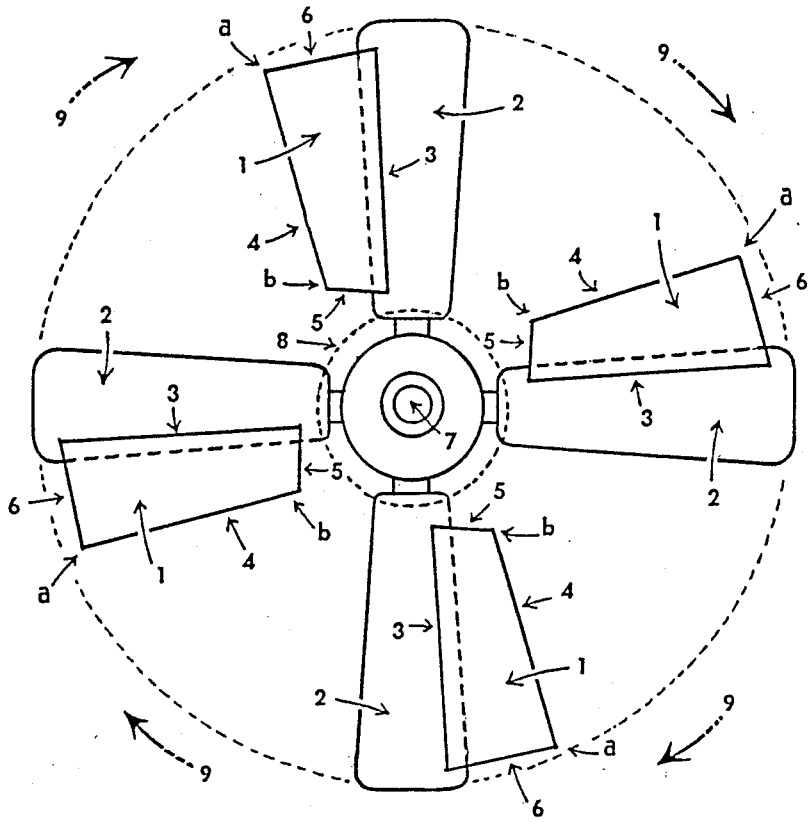
FIG. B
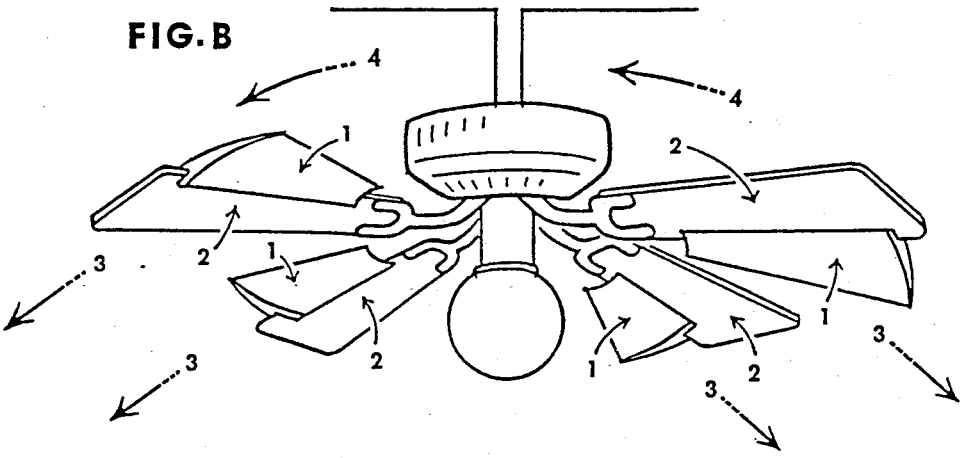

FIG. C
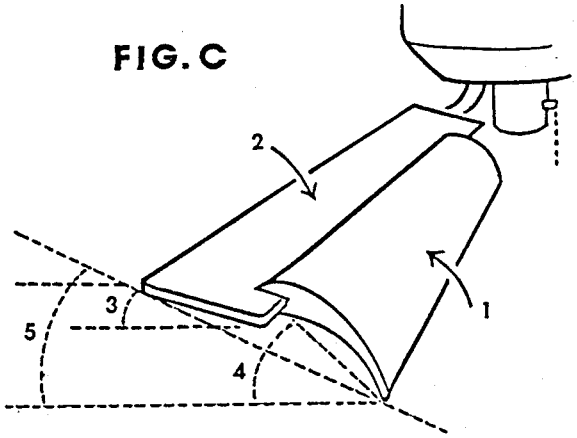
FIG. D
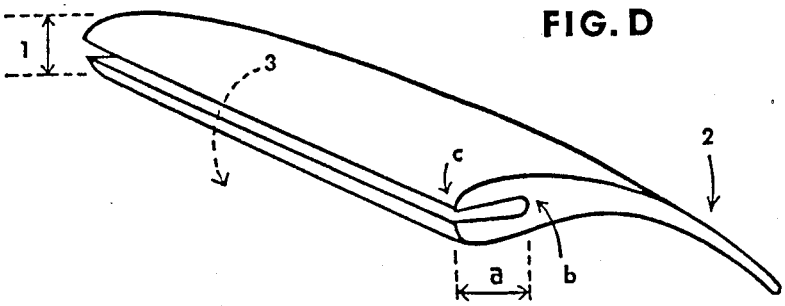
FIG. E
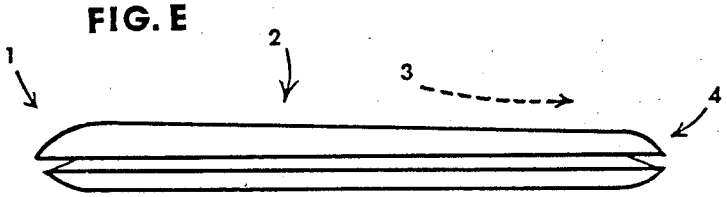
FIG. F
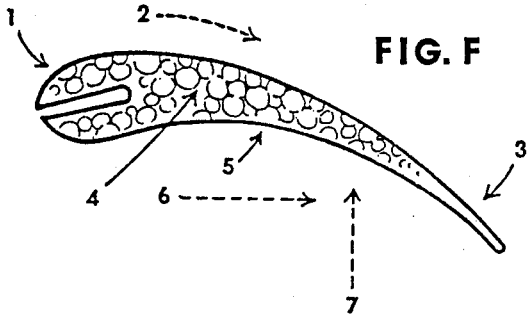

FIG. G
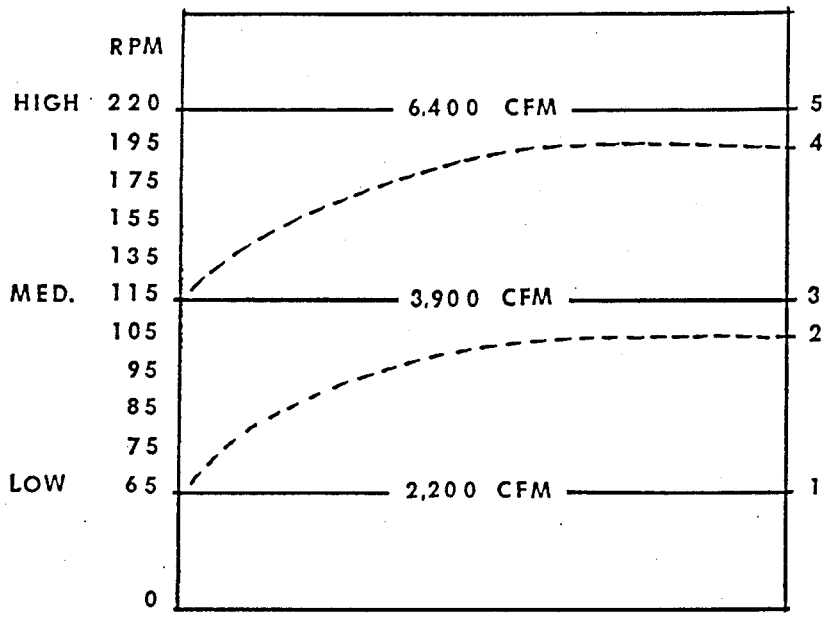
RPM = REVOLUTIONS OF FAN BLADES PER MINUTE.
CFM = CUBIC FEET OF AIR MOVED BY FAN PER MINUTE.

PROPELLER BREEZE ENHANCING BLADES FOR CONVENTIONAL CEILING FANS

SUMMARY OF THE INVENTION

Unlike other previous ceiling fan accessory blade attachments, this invention combines a unique simplicity of form with great effectiveness, safety, and ease of use. The auxiliary blades' aerodynamic design and positioning on the fan's rotating propeller blades enable the ceiling fan to move a much greater volume of propelled breeze, thus eliminating the need to increase the rotational speed of the fan. This results in the saving of electrical energy that would otherwise be consumed if the same air turbulence were to be achieved without use of said auxiliary blades.

Influenced by the high efficiency of modern aircraft wing flaps and augmented to apply to rotary motion, this invention's one-piece construction allows users to simply press-on the auxiliary blades directly and tightly onto the trailing edges of the supporting fan blades. This is done easily and quickly without the use of any tools, hardware, or the needlessly complicated and cumbersome secondary or tertiary gadgets of previous inventions.

BRIEF DESCRIPTION OF THE DRAWINGS

FIG. A shows an aerial view of ceiling fan with auxiliary blades attached.

FIG. B shows a lateral view of ceiling fan with attached auxiliary blades.

FIG. C shows a close-up of an auxiliary blade attached to a main fan blade.

FIG. D shows a detailed embodiment of an auxiliary blade's leading edge with its flexible tapered groove.

FIG. E shows a head-on view of an auxiliary blade.

FIG. F shows a cross section of an auxiliary blade.

FIG. G shows a diagram of the invention's rpm/cfm test results.

DETAILED DESCRIPTION OF THE PREFERRED EMBODIMENTS

As the ceiling fan rotates B-4 a horizontal air pressure is generated and exerted on the concave underside F-6 of the auxiliary blade. This powerful sweeping inner air current simultaneously moves a greater volume of peripheral air diagonally outward B-3 and also creates a pivotal downward levering thrust D-4 on said auxiliary blade's leading edge F-1.

The latter action is further amplified by the vertical uplift generated by the turbulent air speeding over the longer convex top of the auxiliary blade F-2 creating a vacuum which the slower moving air on said blade's concave underside F-5 rushes in vertically to fill F-7. This reciprocal action raises said auxiliary blade and buttresses its leading edge F-1 causing it to adhere even more securely to the supporting fan blade C-2.

Said auxiliary blade attached as shown C-1 will remain gripped tightly to the main fan blade C-2 by means of said auxiliary blade's resiliant molecular structure F-4 and its tongue-in-groove interfacing with the trailing edge of the main fan blade.

As is readily observable, this invention has a high safety factor in relation to other heavier supplemental ceiling fan blade attachments which heretofore have allegedly minimized or ignored the subject of safety involved in their use or misuse.

In the most unlikely event that one of said lightweight auxiliary blades C-1 is improperly mounted on a main fan blade by the user and should subsequently be separated from the ceiling fan during use, said auxiliary blade's lightweight construction is such that it would simply float down to the floor and could then be easily and properly wedged onto the main fan blade C-2. Said auxiliary blade will thus remain tenaciously in place on the main fan blade until or unless it is manually pulled off by the user.

The basic structural design of said auxiliary fan blade is tapered like an aircraft wing flap C-1 and is augmented to apply to rotary motion as mentioned in the summary of the invention. Viewing the auxiliary blade head-on FIG. E, its tip E-2 is tapered in a subtle angular declination E-3 from its interior edge E-1 (c.2.5 cm.) near the central fan axis A-7 toward the outer tip of the auxiliary blade E-4 (c.2 cm.) for maximum strength and streamlined wide air dispersal.

For extra stability and to further maximize air flow, there is a greater depth (c.2.5 cm.>c.2 cm.) at the leading front edge D-1 of said auxiliary blade which tapers convexly toward a lesser depth (c.1 cm). of its trailing edge D-2.

The length of the leading front edge A-3 is c. 40.5 cm. The length of the trailing edge A-4 is c. 39.7 cm. The outside blade angle A-a is c. 90° and the outside blade angle is c. 120°. The specifications for the flexible tapered groove along said auxiliary blade's leading front edge are as follows:

D-a=groove's entry aperture (vertical depth) c.3 mm.

D-b=groove's seating base (horizontal depth) c.3.2 cm.

D-c=groove's rear wall (vertical depth) c.5 mm.

Said auxiliary blade A-1 fits all standard electric ceiling fans (suspended and flush mounted) sizes 36", 48", and 52"×c.5 mm. chord depth. Said auxiliary blade is designed to have a greater chord width at its outer end A-6 (c.15.2 cm.) which tapers to a lesser width at its inner end A-5 (c.9 cm.) near the fan's central housing A-7.

This special design is necessary to create greater turbulence of air flow with maximum lateral air dispersal. The latter function simultaneously extends the propelled breeze of a ceiling fan while preventing a central core downdraft directly below the fan's axial perimeter A-8.

In spatial relation to the chord of the primary fan blade C-2 whose angle of incidence is c.20° from the horizontal C-3 the mounted auxiliary blade's angle of incidence (c.45°) provides an average angle of attack equal to c.32.5° (C-5) thus effectively increasing both said angle and the fan's CFM efficiency by over c.50%.

The super lightweight auxiliary blade, made basically of expanded fluorocarbon+$CO_2$ exerts less stress on the fan motor than blades made of wood, metal, or other plastics which are of heavier weight and denser mass. Said auxiliary blades C-1 thus produce less operational heat, are virtually noiseless, and allow a greater CFM output with money saving economy of energy.

The highly functional design and effective simplicity of this invention FIG. D make it possible to reduce its production costs and subsequently relay a predictably lower price to consumers than other previously proposed heavier and complex supplementary ceiling fan blade assemblies.

TEST RESULTS

Cited as an example of the invention's practical application under the following given conditions without limiting the same thereto, during a 7 day experiment FIG. G the auxiliary blades A-1 were manually attached as described C-1 to the main blades A-2 of a 52" electric "Hunter" ceiling fan flush mounted at center ceiling of the test room (12'×15'×8'). The fan operated non-stop for 7 days (168 hours).

Result: The auxiliary blades A-1 had remained perfectly seated on the supporting blades A-2 and had performed virtually noiseless while significantly increasing the normal CFM breeze factor of the ceiling fan. During an outdoor temperature of c.80° F. the indoor test room was comfortably cooled when the fan's control was set at LOW speed (65 rpm). As a direct result of using said auxiliary blades, the super normal breeze output of cubic feet of air per minute (cfm) at low speed G-1 was nearly G-2 to the fan's normal breeze factor at medium speed G-3.

At the same test site, using said auxiliary blades B-1 attached to the ceiling fan rotating at MEDIUM speed (115 rpm) G-3 the resulting super normal breeze output of the fan was nearly equal G-4 to the fan's normal cfm breeze factor at high speed G-5.

These tests also indicated that the HIGH speed setting (220 rpm) was inappropriate for use with the auxiliary blades B-1 as they created too much air turbulence which resulted in excessive breeze and vibration of the auxiliary blades.

This was interpreted as a successful test result because: (a) It proved the effectiveness of said auxiliary blades, and (b) The purpose of the invention was obviously to increase the efficiency of the ceiling fan at its LOWER settings which the invention had certainly accomplished.

Supplemental to the funtional aspects of this invention, without limiting the same thereto, said auxiliary fan blades A-1 offer many decorative options to the user; one of which includes luminous linear designs (not shown) on the underside of said auxiliary blades F-5. During fan operation these designs create concentrically moving, multi-colored optical effects to enhance the atmosphere of a room. Another option is the application of a variety of scents (packaged separately) that would adhere to the underside of said auxiliary blades.

I claim:

1. Propeller breeze enhancing blade attachments for conventional ceiling fans wherein said auxiliary blades wedge firmly onto the trailing edges of primary fan blades to increase the angle of incidence and thus create a greatly increased dual air flow outward and downward in relation to the fan's central core; said blade attachments comprised of top and bottom surfaces, leading and trailing side edges, and inner and outer ends; configuration of said top and bottom surfaces being convex and concave respectively, with said leading edge being of greater depth than said trailing edge, and said outer end being of greater width and lesser depth than said inner end, with said leading edge housing the means of securing said auxiliary blades to the primary fan blades via a flexible tapered groove along said auxiliary blades' leading edge extending from their inner end to their outer end.

2. The propeller breeze enhancing blade attachments of claim 1 in which said auxiliary blades are grooved along the entire length of their leading edge, with said groove being flexible and tapered to tightly wedge onto and firmly grip the trailing edges of the main fan blades, said groove's entry aperture being c.3 mm. in vertical depth, its seating base being c.3.2 cm. in horizontal depth, and said groove's rear wall being c. 5 mm. in vertical depth.

3. The propeller breeze enhancing blade attachments of claim 2 in which said auxiliary blades wedge securely onto the primary fan blades by means of: (a) the flexible tapered groove which is c.2 mm. less in depth at its front than at its rear to insure a tight grip, and (b) during fan operation the horizontal air pressure and uplift created by the interaction of the convex top and concave underside of said auxiliary blades secures them further to the main supporting blades.

4. The propeller breeze enhancing blade attachments of claim 2 in which said auxiliary blades accept all standard size ceiling fan blade lengths of 36", 48", and 52", with a main blade chord depth of c.5 mm.

5. The propeller breeze enhancing blade attachments of claim 1 in which said auxiliary blades are of one-piece construction with no separate parts to wear out, service, or replace, and operate virtually noiseless and maintenance free.

6. The propeller breeze enhancing blade attachments of claim 1 in which said auxiliary blades are of super light weight and of sparse mass, being constructed basically of expanded fluorocarbon+$CO_2$ and thus create less drag on the ceiling fan motor that other auxiliary blades made of heavier plastics, wood, or metal.

7. The propeller breeze enhancing blade attachments of claim 1 in which the vertical depth of the tapered leading edge of said auxiliary blades is c.2.5 cm.>2 cm. with the greater depth being at said blades' inner end, the chord depth of said auxiliary blades' trailing edge is c.1 cm., the length of said blades' leading edge is c.40.7 cm., the length of said blades' trailing edge is c.39.5 cm., and the chord width of said auxiliary blades is c.15.2 cm. at their outer end, and c.9 cm. at their inner end.

8. The propeller breeze enhancing blade attachments of claim 1 in which said auxiliary blades' angle of incidence is c.45° and the main fan blades' original angle of incidence is c.20°, the combined angle of incidence thus being increased to c.32.5°.

9. The propeller breeze enhancing blade attachments of claim 7 in which the enlarged angle of incidence from c.20° to c.32.5° represents a c.50% increase, and produces a correlative increase of c.50% in the fan's CFM output efficiency.

10. The propeller breeze enhancing blade attachments of claim 1 in which said auxiliary blades will be available with optional decorative luminous designs and air freshener tabs on the underside of said blades.

* * * * *

UNITED STATES PATENT AND TRADEMARK OFFICE

CERTIFICATE OF CORRECTION

PATENT NO. : 4,892,460

DATED : January 9, 1990

INVENTOR(S) : Steve J. Volk

It is certified that error appears in the above-identified patent and that said Letters Patent is hereby corrected as shown below:

Title page:

Abstract, line 2, add an "s" to the word "attachment(s)"

Column 2, line 23, delete "of", insert "at"

Column 3, line 7, insert "standard" in front of "52"

Column 3, line 8, delete "Hunter"

Column 3, line 20, after "nearly" insert "equal"

Column 3, line 55, after "attachments" insert "being"

Column 4, line 34, claim 6, after "and" insert "superior strength"

Column 4, line 35, claim 6, delete "fluorocarbon + $CO_2$", insert "polyethylene"
delete "create", insert "exert"

Column 4, line 36, claim 6, delete "the", insert "a"
delete "that", insert "than"
delete "auxiliary", insert "proposed accessory"

Column 4, line 37, claim 6, after "metal," insert "etc;" after "etc;" add "said construction of S.J. Volk's patented auxiliary blades shall not be limited to EPE, as other suitable materials may become available through technological research & development."

UNITED STATES PATENT AND TRADEMARK OFFICE

CERTIFICATE OF CORRECTION

PATENT NO. : 4,892,460

DATED : January 9, 1990

INVENTOR(S) : Steve J. Volk

It is certified that error appears in the above-identified patent and that said Letters Patent is hereby corrected as shown below:

Column 4, line 58, claim 10, delete "will", insert "may"

line 59, after "available" insert "in white and decorator colors;"

delete "decorative" after "designs" insert "on the undersides of said auxiliary blades; and may also be available with stick-on scents to enhance the atmosphere of a ceiling fan area."

delete "and"

Column 4, line 60, claim 10, delete "air freshener tabs on the underside of said blades".

Signed and Sealed this

Eleventh Day of December, 1990

*Attest:*

HARRY F. MANBECK, JR.

*Attesting Officer*

*Commissioner of Patents and Trademarks*